US006983572B2

(12) United States Patent
Neno, Jr. et al.

(10) Patent No.: US 6,983,572 B2
(45) Date of Patent: Jan. 10, 2006

(54) ORGANIZER FOR BUNDLING AND RECYCLING NEWSPAPERS

(75) Inventors: Louis Neno, Jr., Manahawkin, NJ (US); Roxane Neno, 1516 Breakers Dr., Manahawkin, NJ (US) 08050

(73) Assignee: Roxane Neno, Manahawkin, NJ (US)

( * ) Notice: Subject to any disclaimer, the term of this patent is extended or adjusted under 35 U.S.C. 154(b) by 11 days.

(21) Appl. No.: 10/866,628

(22) Filed: Jun. 14, 2004

(65) Prior Publication Data

US 2005/0204701 A1 Sep. 22, 2005

Related U.S. Application Data

(60) Provisional application No. 60/554,943, filed on Mar. 22, 2004.

(51) Int. Cl.
*B65B 27/08* (2006.01)

(52) U.S. Cl. ..... 53/399; 53/592; 53/390; 100/2; 100/34

(58) Field of Classification Search ..... 53/399, 53/414, 416, 419, 137.2, 138.6, 139.4, 582, 53/590, 592, 390; 100/1, 2, 8, 34; 211/50; D3/304, 306; D6/457, 475
See application file for complete search history.

(56) References Cited

U.S. PATENT DOCUMENTS

| | | | | |
|---|---|---|---|---|
| 513,763 | A * | 1/1894 | Conant | 100/34 |
| 1,972,173 | A * | 9/1934 | Spoor et al. | 100/33 R |
| 5,159,875 | A * | 11/1992 | Cohen | 100/34 |
| 5,388,506 | A * | 2/1995 | Vargas et al. | 100/34 |

FOREIGN PATENT DOCUMENTS

EP 0105557 A2 * 4/1984

* cited by examiner

*Primary Examiner*—Stephen F. Gerrity
(74) *Attorney, Agent, or Firm*—Clifford G. Frayne

(57) ABSTRACT

An apparatus for the bundling of newspapers and magazines for recycling comprising a stand having a base, four upstanding legs positioned on the base proximate the corners thereof, each of the legs supporting a separate segmented tray member, each segmented tray member having a planar base secured to a leg member, and two adjacent upstanding edges on the outer periphery forming an "L", the upstanding edges defining a collection area for the placement and support of newspapers and magazines to be recycled, the base member having an upstanding spindle mounted on a pivot arm for the rotatable positioning of a source of twine, cord or string, the pivot arm allowing for the disbursal of twine beneath the bundle in a lateral direction and in a longitudinal direction when pivoted from lateral position.

9 Claims, 4 Drawing Sheets

ORGANIZER FOR BUNDLING AND RECYCLING NEWSPAPERS

CROSS REFERENCE TO RELATED APPLICATIONS

Applicant claims the benefit of provisional application Ser. No. 60/554,943, filed Mar. 22, 2004.

BACKGROUND OF THE INVENTION

1. Field of the Invention

The present invention is related to an apparatus for securing newspapers and magazines for recycling, and in particular, for an apparatus which allows for the bundling of newspapers and magazines in a facile manner.

2. Description of the Prior Art

Recycling laws require papers and magazines to be secured in bundles for collection and recycle. Cord, twine or string is the securing means of choice in bundling newspapers and magazines.

In performing a typical bundling operation, the individual must determine an appropriate quantity of newspapers or magazines per bundle. The individual must then unwind cord, string or twine and wrap the bundle of papers in a latitudinal orientation or a longitudinal orientation and then repeat the winding in the opposite direction. The cord, string or twine must then be tied off and the bundles secured by a knot. This procedure oftentimes requires flipping of the bundle several times in order to wrap the string, cord or twine about the bundle. This procedure is cumbersome and time consuming and is particularly cumbersome for individuals such as the elderly who suffer from arthritic afflictions to the hands.

OBJECTS OF THE INVENTION

An object of the present invention is to provide for a novel organizer for bundling newspapers and magazines for recycle in which the apparatus is dimensioned to the planar dimensions of the newspaper and magazines for the production of uniform bundles of magazines or newspapers for recycling.

Another object of the present invention is to provide for a novel apparatus for bundling newspapers and magazines for recycle wherein the apparatus elevates the bundles of newspapers and magazines allowing access to the underside of the bundle.

A further object of the present invention is to provide for a novel apparatus for bundling newspapers and magazines for recycle in which the apparatus incorporates a securing means in the form of string, cord or twine on a spindle which is pivotal on the apparatus from a latitudinal side to a longitudinal side.

A still further object of the present invention is to provide for a novel apparatus for bundling newspapers or magazines for recycle which provides a storage means for a cutting means for severing the cord, twine or string.

A still further object of the present invention is to provide for a novel apparatus for the bundling of newspapers and magazines for recycle in which the apparatus permits the securing of the bundle without the need for flipping the bundle in order to wrap the securing means thereabout.

A still further object of the present invention is to provide for a novel apparatus for the bundling of newspapers or magazines for recycling which allows access to the bottom and top side of the bundle without the requirement of flipping the bundle in order to secure same.

A further object of the present invention is to provide for a novel organizer for bundling newspapers and magazines that is sized for convenient storage.

A still further object of the present invention is to provide for a novel organizer for bundling newspapers and magazines which also allows for smaller pieces of paper, such as junk mail or the like, to be included in the bundle and to be secured.

A still further object of the present invention is to provide for a novel organizer for bundling newspapers and magazines which allows for the use of all types of twine and string, in either balls, spools or the like.

SUMMARY OF THE INVENTION

An apparatus for the bundling of newspapers and magazines for recycling comprising a stand having a base, four upstanding legs positioned on said base proximate said corners, each of said legs supporting a separate segmented tray member, each segmented tray member having a planar base secured to a leg member, and two adjacent upstanding edges on the outer periphery forming a "L", the upstanding edges defining a collection area for the placement of support of papers and magazines to be recycled, the base member having an upstanding spindle mounted on a pivot mount for the rotatable positioning of a source of twine, cord or string, the pivot mount allowing for the disbursal of twine beneath the bundle in a lateral direction and in a longitudinal direction when pivoted from the lateral position.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
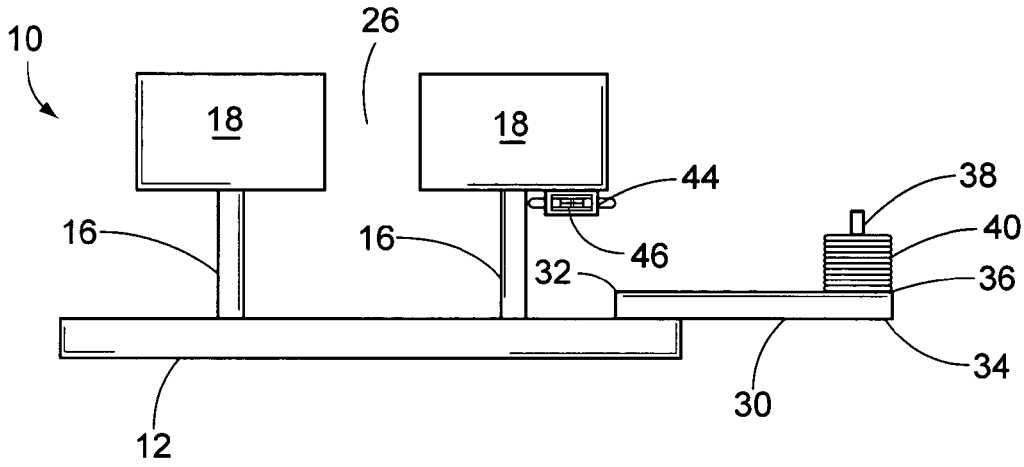
FIG. 1 is an end view of the apparatus of the present invention.
Figure 2:
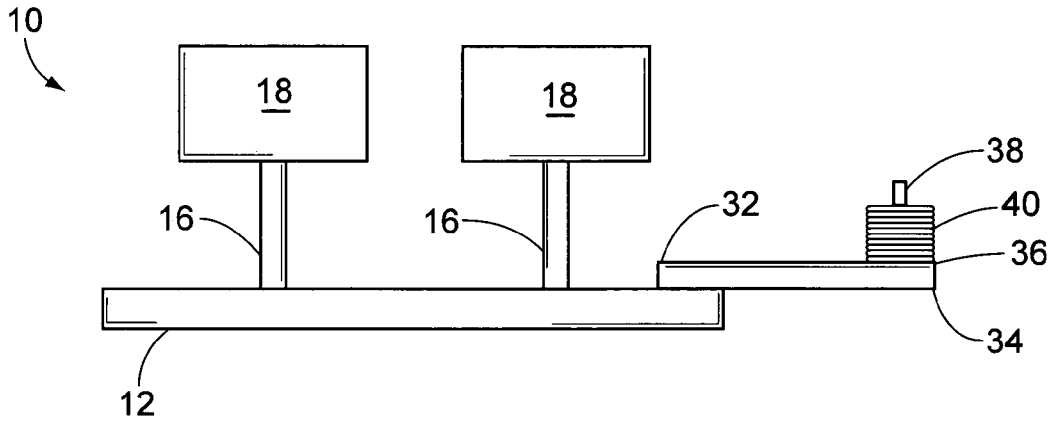
FIG. 2 is a side view of the apparatus of the present invention.
Figure 3:
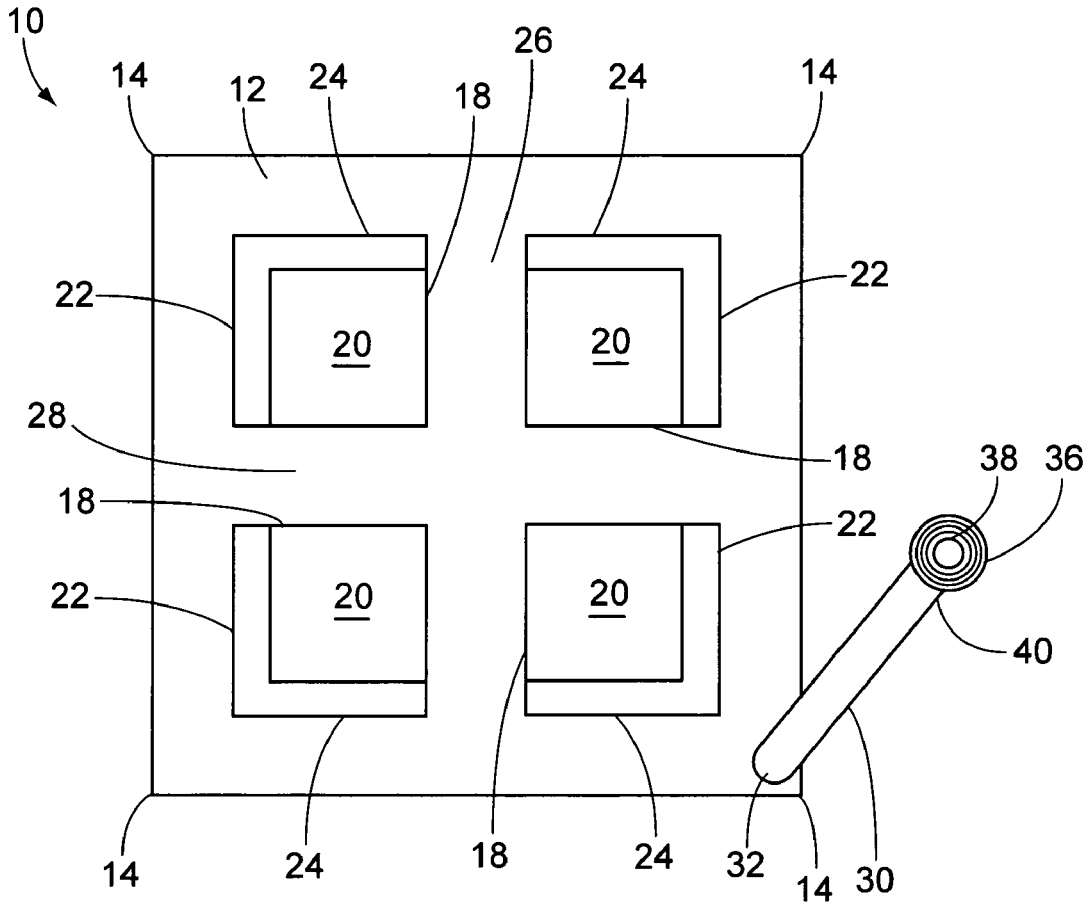
FIG. 3 is a top view of an apparatus of the present invention.

FIG. 1 is an end view of the organizer 10 of the present invention, FIG. 2 a side view, and FIG. 3 a top view. The organizer 10 comprises a base member 12 which in the embodiment illustrated is generally rectangular in configuration. The base member 12 has upstanding from points proximate the corners 14 thereof, four leg members 16. Each of the leg members 16 supports segmented tray members 18, the segmented tray portion 18 comprising a planar tray base member 20 and two abutting side walls 22 and 24.

In this configuration as best can be seen in FIG. 2, the four segmented tray members 18 are separated from each other by a latitudinal gap 26 and a longitudinal gap 28. The side walls 22 and 24 of each segmented tray member 18 form the corners of a tray and the height of the abutting side walls 22 and 24 are such that they allow for the accumulation of papers and magazines between the segmented tray members 18 to a height so as to provide for a bundle of newspapers or magazines that is easily wrapped and transported. The purpose of latitudinal and longitudinal gaps 26 and 28 between the segmented tray members 18 will become apparent upon consideration of the manner in which the newspapers or magazine are secured.

Figure 4:
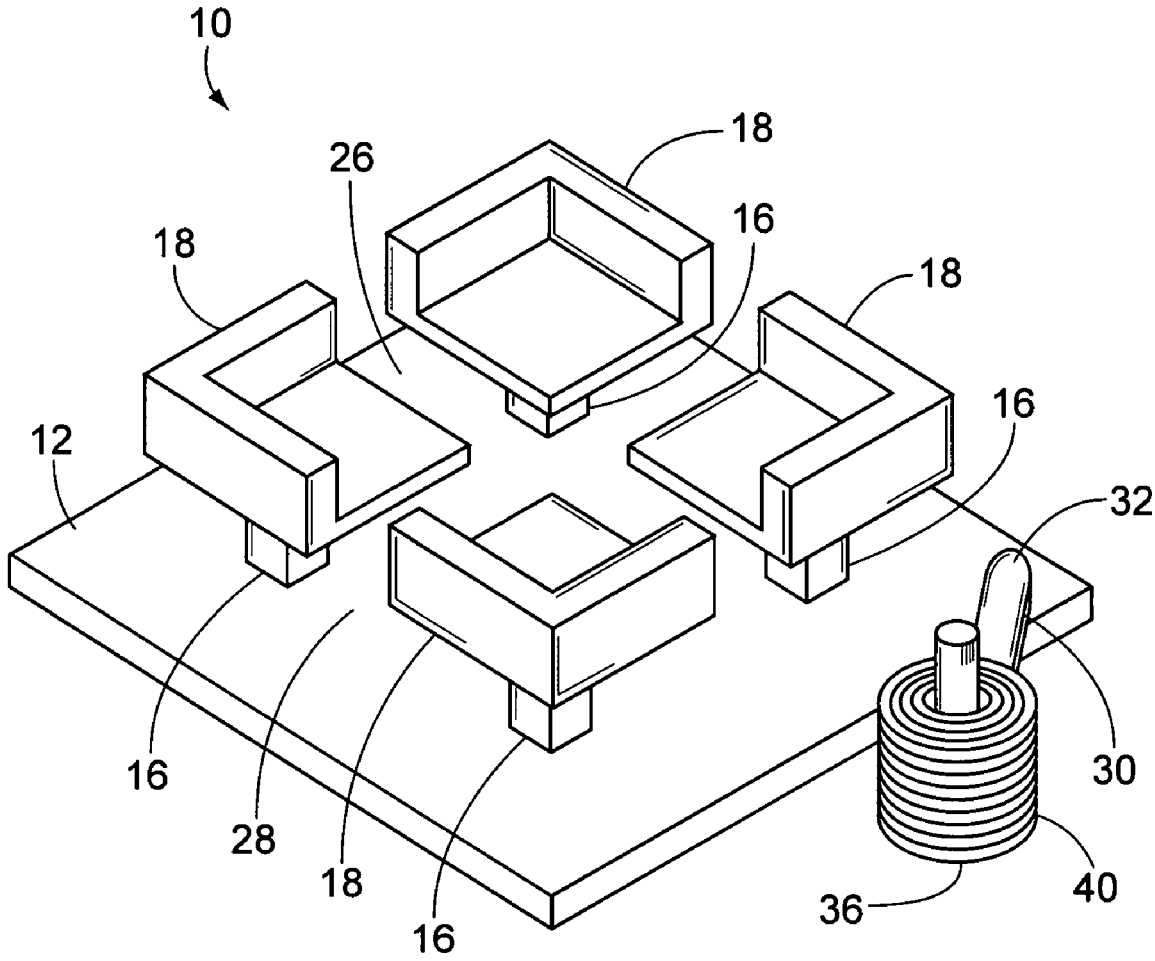
FIG. 4 is a perspective view of an apparatus of the present invention.
Figure 5:
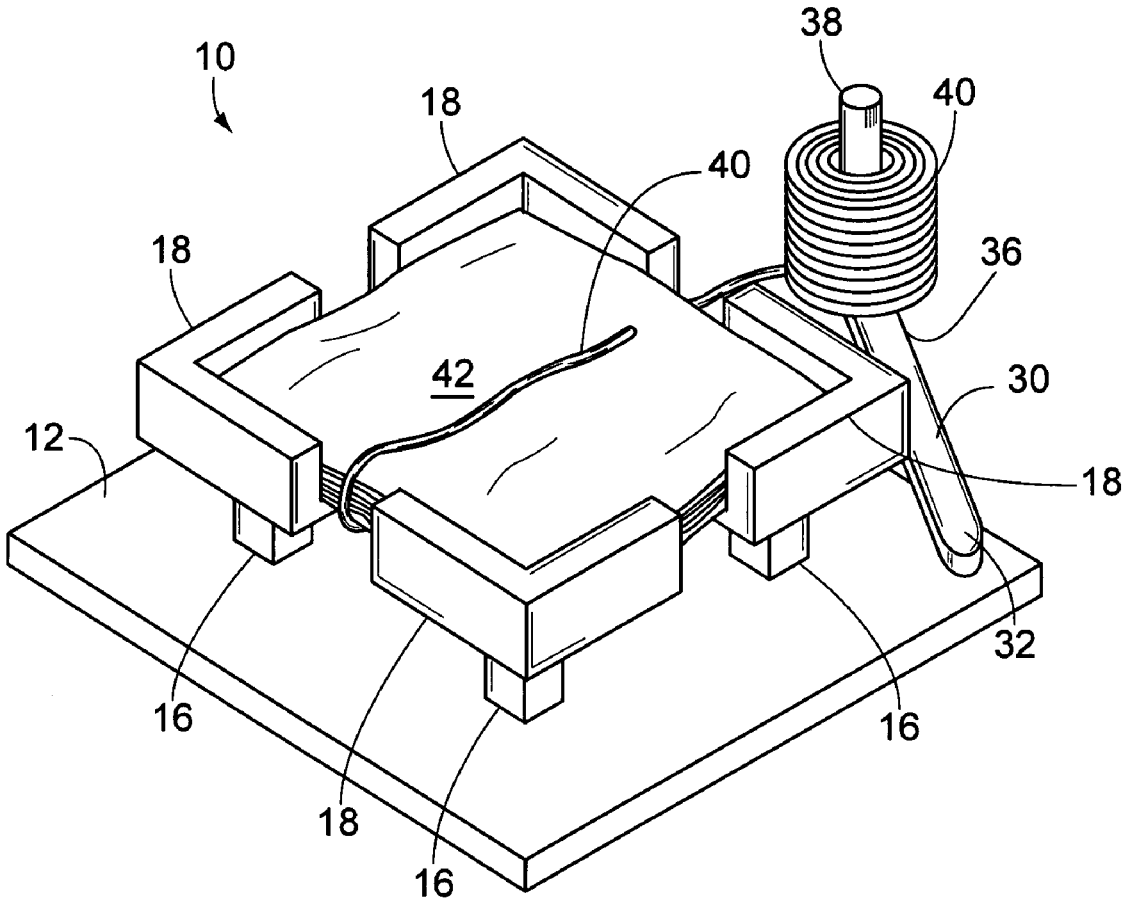
FIG. 5 is a perspective view of an apparatus of the present invention with the papers and magazines positioned therein.

Positioned in one corner of the base member 12 is a horizontal pivot arm 30 pivotally secured to the base member at first end 32 and secured at second end 34, to a twine support platform 36 and spindle 38. Pivot arm 30 is secured to base member 12 in a manner of such that it allows for the pivot arm 30 to swing in one direction to allow the alignment of the twine support platform 36, spindle 38 and twine 40 to align with the longitudinal gap 28 between the segmented tray members and to swing in an opposing direction to align the twine support platform 36, spindle 38 and twine 40 with the latitudinal gap 26 between segmented tray members. FIG. 4 illustrates this positioning with respect to the longitudinal gap 28 and FIG. 5 represents this positioning with respect to the latitudinal gap 26. This configuration allows the user to easily extract twine 40 from the spindle 38 and to encircle the bundle of newspapers and magazines 42 about its latitudinal axis and then to reposition the twine and spindle to extract twine to wrap about the longitudinal axis and secure same. This design allows for an individual to easily determine when a bundle needs to be secured because the bundle 42 will necessarily proximate the height of the side walls of the segmented tray members 18. The individual can easily extract twine 40 from the spindle 38 to wrap the papers and magazines 42 in a longitudinal orientation and then in a latitudinal orientation or vice versa. The bundle can then be removed for recycling. The organizer 10 can also incorporate a slot 44 beneath one of the segmented tray members 18 for the receipt and storage of a pair of scissors 46 utilized to sever the used twine from that twine 40 remaining on the spindle.

The present invention can be fabricated from a variety of different materials. It could be fabricated decoratively and functionally in solid wood or it could be fabricated both functionally and less expensively in plastic, such as ABS or from metal.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

What is claimed:

1. An organizer for the bundling of newspapers and magazines for recycling, said organizer comprising:

a base member having upstanding support members, said support members supporting an elevated tray member, said tray member having adjacent abutting side walls upstanding from each corner of said tray member, said tray member being segmented by a longitudinal gap and a lateral gap bisecting said longitudinal gap, said segmented tray member in cooperation with said upstanding side walls for the receipt of a plurality of newspapers, magazines and the like for recycling;

a horizontal pivot arm having a first end rotatably secured to said base member, said horizontal pivot arm having a support surface formed on its second end, said support surface having an upstanding spindle secured thereto, said support surface and upstanding spindle for the rotatable support of a ball of linear securing means, said pivot arm length dimensioned so as to selectively position said support surface, upstanding spindle and ball of linear securing means in sequential alignment with said longitudinal gap of said segmented tray member and said lateral gap of said segmented tray member.

2. The organizer in accordance with claim 1 wherein newspaper and magazines are deposited on said segmented tray member and said pivot arm is pivoted such that said support surface and said upstanding spindle and said ball of linear securing means are in alignment with one of said gaps in said segmented tray member and said linear securing means is unraveled from said ball of linear securing means and secured and fastened about a girth of said stack of newspapers and magazines; said linear securing means being severed from said ball of linear securing means, and said pivot arm rotatably positioned so as to align said support surface and said upstanding spindle and said ball of linear securing means with the other of said gaps of said segmented tray member wherein said linear securing means is unraveled from said ball of linear securing means and secured and fastened about an opposing girth of said newspapers and magazines.

3. The organizer in accordance with claim 2 wherein said elevated tray member with said longitudinal and lateral gaps allows the user facile access to the underside of said stack of newspapers and magazines to permit the securing of the stack of newspapers and magazines about said longitudinal girth and said lateral girth of said stack of newspapers and magazines.

4. The organizer in accordance with claim 1 wherein said side walls of said elevated tray member are of a sufficient height to retain a height of newspapers and magazines of a manageable weight.

5. The organizer in accordance with claim 1 wherein said segmented tray members has formed on an underside thereof, a storage slot for the storage of a severing means for said ball of linear securing means.

6. The organizer in accordance with claim 1 wherein said organizer is constructed of a polymer material.

7. The organizer in accordance with claim 1 wherein said organizer is constructed of metal.

8. The organizer in accordance with claim 1 wherein the organizer is constructed from wood.

9. A method for organizing and bundling newspapers and magazines for recycling, said method comprising:

a. forming a base member having a plurality of upstanding support members for support of an elevated tray member, said tray member being formed with adjacent abutting corner walls upstanding from said tray member;

b. segmenting said tray member with a longitudinal gap and a lateral gap bisecting said longitudinal gap;

c. positioning a horizontal pivot arm on said base member, said horizontal pivot arm having a first end secured to said base member and a second end having a support surface and spindle member for the receipt of a ball of linear securing means;

d. positioning newspapers and magazines to be recycled on said tray member to a desired height;

e. rotating said horizontal pivot arm such that said support surface, said spindle member, and said ball of linear securing means are aligned with one of said gaps in said tray member;

f. unraveling a selected length of linear securing means from said ball of linear securing means and securing and fastening said selected length about a girth of said stack of newspapers and magazines;

g. severing said selected length of linear securing means from said ball of linear securing means;

h. repositioning said horizontal pivot arm so as to align said support surface, said spindle member and said ball of linear securing means in alignment with the other of said gaps in said tray member;

i. repeating steps f through g;

j. removing said secured stack of newspapers and magazines from said tray member;

k. repeating steps d through j.

* * * * *